United States Patent [19]

Saur

[11] Patent Number: 4,485,613

[45] Date of Patent: Dec. 4, 1984

[54] APPARATUS FOR PRODUCING TUBULAR-POUCH PACKAGES

[75] Inventor: Walter Saur, Ditzingen, Fed. Rep. of Germany

[73] Assignee: Robert Bosch GmbH, Stuttgart, Fed. Rep. of Germany

[21] Appl. No.: 358,987

[22] Filed: Mar. 17, 1982

[30] Foreign Application Priority Data

Mar. 18, 1981 [DE] Fed. Rep. of Germany ..... 3110482

[51] Int. Cl.[3] ..... B65B 9/06

[52] U.S. Cl. ..... 53/551; 53/373; 156/498; 493/191

[58] Field of Search ..... 53/550, 551, 552, 553, 53/554, 373, 388, 451, 479; 156/203, 466, 498, 583.1, 583.4; 493/190, 191

[56] References Cited

U.S. PATENT DOCUMENTS

| | | | |
|---|---|---|---|
| 2,419,982 | 5/1947 | Zwoyer | 53/373 |
| 2,928,220 | 3/1960 | Kannengiesser et al. | 53/551 |
| 2,960,808 | 11/1960 | Pike | 53/551 X |
| 3,221,469 | 12/1965 | Murray | 53/552 X |
| 3,333,391 | 8/1967 | Horeth et al. | 53/548 X |
| 3,606,727 | 9/1971 | Davis | 53/373 X |

*Primary Examiner*—Robert L. Spruill
*Assistant Examiner*—Donald Studebaker
*Attorney, Agent, or Firm*—Edwin E. Greigg

[57] ABSTRACT

An apparatus for producing tubular-pouch packages with heat-sealed transverse seams. In order that the bottom seam will harden rapidly following the securing process, a cooling medium is blown onto it by a nozzle. The nozzle is disposed in the tubular body from which tubular-pouch packages are made and is directed at the pressing plane of the transverse-seam welding apparatus.

6 Claims, 2 Drawing Figures

APPARATUS FOR PRODUCING TUBULAR-POUCH PACKAGES

BACKGROUND OF THE INVENTION

The invention is based on an apparatus for producing tubular-pouch packages as described in the specification. In an apparatus of this kind known in German Offenlegungsschrift No. 15 86 328, cooling air is blown onto the transverse seam, which closes the bottom of the tubular-pouch package, after the heat sealing chuck of the transverse-seam welding apparatus has been lifted away from the tube. The transverse seam thus hardens rapidly, so that there is little time for the product, which is introduced into the end of the tube while the heat sealing process is still going on, to force the still-soft sealed seam open. However, with thick packaging materials, a long period of time is required to draw off the heat, and it frequently happens that the bottom seam of a tubular-pouch package will burst open.

OBJECT AND SUMMARY OF THE INVENTION

The apparatus according to the invention has the advantage that the cooling medium is blown directly onto the particular edge area of the transverse seam at which the product would begin to force the seam open. As a result, the weakest point is cooled off very rapidly and effectively, directly following the heat sealing operation so that pouch-type packages of very great strength can be produced, while attaining high apparatus output. It is particularly advantageous that a protective gas is used as the cooling medium, so that the product being packaged is packed in an inert atmosphere.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
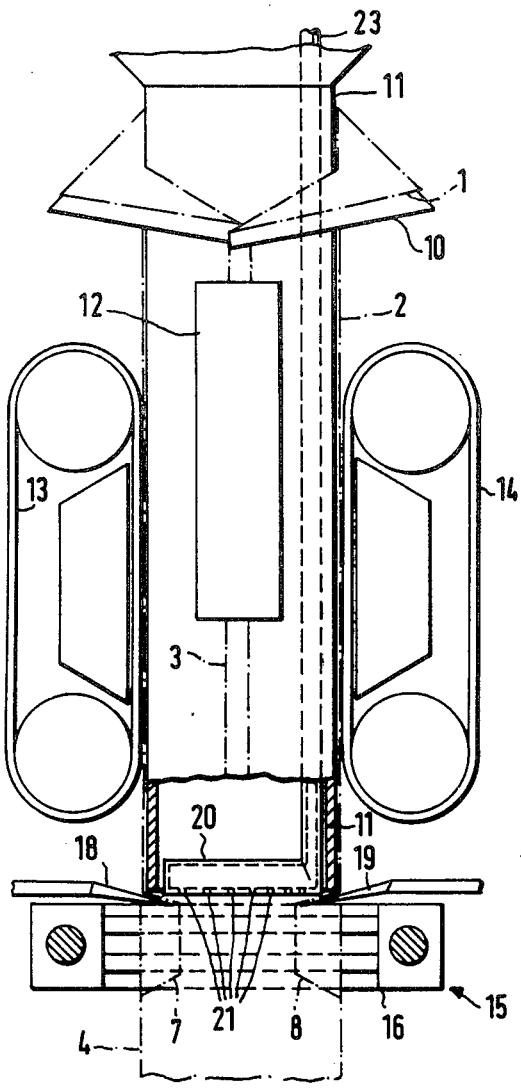
FIG. 1, in simplified fashion, shows an apparatus for producing tubular-pouch packages, seen in front view and partially in section.
Figure 2:
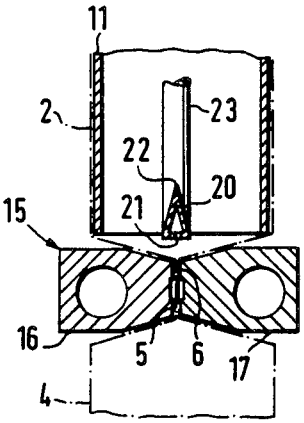
FIG. 2 shows a fragmentary portion of the apparatus for producing tubular-pouch packages seen in cross section, with the view turned at an angle of 90°.

A strip of packaging material 1 being unwound from a supply roll (not shown) and capable of being heat-sealed or secured together in any suitable manner is guided over a shaping shoulder 10, which shapes it around a vertical shaping and filling tube or mandrel 11 into a tubular body 2. A longitudinal sealing chuck 12 secures the two overlapping rims into a longitudinal seam 3. Two endless conveyor belts 13, 14 which are disposed adjacent to the shaping and filling tube or mandrel 11 and intermittently driven pull the tubular body 2 downwardly by one pouch length at a time. Below the shaping and filling mandrel 11, there is a stationary transverse-seam welding apparatus 15 with two sealing chucks 16, 17 displaceable transversely to the axis of the tubular body. During the intervals when the conveyor belts 13, 14 are not drawing the tubular body 2 downwardly, the sealing chucks 16, 17 compress a narrow area of the tubular body 2, thereby partitioning the end part of the tubular body, which is suspended below the transverse-seam welding apparatus and contains a portion of the product being packaged, to form a tubular-pouch package 4. By transmitting pressure and heat to two narrow strips of the flat-pressed area of the tubular body 2, a top seam 5 is securely fastened together on the filled tubular-pouch package 4, while at the same time a bottom seam 6 is welded together on the new end of a newly formed pouch formed by the tubular body 2. In order to draw in side folds 7, 8 in the vicinity of the top seam 5 and bottom seam 6, two triangular folder elements 18, 19 draw the side walls of the tubular body 2 inwardly toward the axis of the tubular body when the securing chucks 16, 17 move toward one another. As soon as the securing chucks 16, 17 have compressed the tubular body 2, a quantity of product is poured into the end thereof by the shaping and filling tube 11.

In order to prevent the product introduced into the end of the tubular body from being able by its weight to force open the hot, not-yet-hardened bottom seam 6 of the tubular body 2 once the securing chucks 16, 17 move apart again, a nozzle 20 for a cooling medium is disposed inside the lower opening of the shaping and filling tube 11, at a short distance from the top of the securing chucks 16, 17. The nozzle 20 extends over virtually the entire width of the opening of the shaping and filling tube 11 parallel with the formed seam and has a plurality of outlet openings 21 on its underside, which are directed toward the bottom seam 6 on the inside of the tubular body 2 in the plane in which the securing chucks 16, 17 close. In order that the product already packaged in the tubular body 2 will not be more than slightly hindered in its passage past the nozzle 20 located inside the product filling tube as the tubular body 2 is being advanced, the elongated nozzle 20 is triangular in cross section, with a sharply-pointed tip 22 pointing in the opposite direction in which the tubular body 2 is advanced. For supplying the cooling medium to be blown onto the bottom seam 6, the nozzle 20 is connected to a tube 23 disposed in a manner which is offset to the side within the shaping and filling tube 11.

The cooling medium, for instance air, is blown onto the bottom seat 6 along the seam on the inside of the pouch preferably in spurts, each spurt beginning shortly before the securing chucks 16, 17 move apart. The cooling medium can also flow continuously out of the nozzle 20; this is advantageous if a gas which is protective of the product is used as the cooling medium.

Instead of a nozzle 20 having a multiplicity of outlet openings, it is also possible to use a nozzle having an outlet slit. In certain cases, it is sufficient to use a nozzle which exposes only the central area of the bottom seat to cooling medium, rather than one encompassing the entire width of the seam.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United Stated is:

1. An apparatus for producing tubular-pouch packages having a device for shaping a tubular body out of a strip of packaging material capable of being secured together under pressure, said apparatus including a transverse-seam forming means for partitioning off individual pouch packages formed from said tubular body by flat-pressing a narrow area of said tubular body along a pressing plane and applying heat onto said transverse seam which seals said tubular body along the seam, and a nozzle positioned in a fixed position inside of said tubular body juxtaposed said transverse-seam forming means, said nozzle extending over substantially the entire width of said transverse seam formed in said tubular body and arranged to blow a cooling medium onto said transverse seam along its inside prior to movement of said transverse-seam forming means from said seam, and said nozzle being disposed at a short distance above said transverse-seam forming means and said nozzle including an outlet directed toward the pressing plane of said transverse-seam forming means for directing a coolant air flow onto said seam.

2. An apparatus as defined by claim 1, characterized in that said nozzle includes a plurality of outlet openings.

3. An apparatus as defined by claim 1, characterized in that said nozzle has at least one outlet opening.

4. An apparatus as defined by claim 1, characterized in that said nozzle is triangular in cross section, the apex of said triangle arranged to extend upwardly in opposition to the feed of said tubular body.

5. An apparatus as defined by claim 1, characterized in that said nozzle is connected with a supply tube and is supported thereby.

6. An apparatus as defined by claim 5, characterized in that said nozzle has an end wall and said supply tube is connected to said end wall to form an L-shaped member.

* * * * *